United States Patent [19]

Faust et al.

[11] Patent Number: 4,671,581

[45] Date of Patent: Jun. 9, 1987

[54] DRAWER

[75] Inventors: Karl-Volker Faust, Bielefeld; Gerhard Schröeder, Bad Oeynhausen, both of Fed. Rep. of Germany

[73] Assignee: Paul Hettich GmbH & Co., Kirchlengern, Fed. Rep. of Germany

[21] Appl. No.: 841,520

[22] PCT Filed: May 24, 1985

[86] PCT No.: PCT/DE85/00177

§ 371 Date: Jan. 31, 1986

§ 102(e) Date: Jan. 31, 1986

[87] PCT Pub. No.: WO85/05541

PCT Pub. Date: Dec. 19, 1985

[30] Foreign Application Priority Data

Jun. 5, 1984 [DE] Fed. Rep. of Germany ... 8417057[U]

[51] Int. Cl.[4] ..... A47B 88/00

[52] U.S. Cl. ..... 312/330 R

[58] Field of Search ..... 312/111, 140, 257 SK, 312/257 R, 264, 330 R, 265, 330 SM, 257 SM; 220/4 R, 80

[56] References Cited

U.S. PATENT DOCUMENTS 3,862,784 1/1975 Heinrich ..... 312/140

FOREIGN PATENT DOCUMENTS 2722465 5/1977 Fed. Rep. of Germany .
2715830 7/1977 Fed. Rep. of Germany .
2052956 2/1981 United Kingdom ..... 312/140
2131286 6/1984 United Kingdom ..... 312/330 R

*Primary Examiner*—Kenneth J. Dorner
*Assistant Examiner*—Joseph Falk
*Attorney, Agent, or Firm*—Michael J. Striker

[57] ABSTRACT

The drawer has a front plate provided with a recess in its upper edge area. The recess is configured in such a way that the front plate is comprised of a rectangular plate (5) made of wooden or plastic material and of two profiled parts which are secured in the upper corner area of the plate and comprising a first upright (6*a*) seizing the respective corner and a second upwardly projecting upright. To the upwardly projecting uprights of the profiled parts there is secured an upper strut which is also secured to the rear wall of the drawer.

4 Claims, 4 Drawing Figures

DRAWER

BACKGROUND OF THE INVENTION

The subject invention relates to a drawer with a front plate provided with a recess in its upper edge area and with struts provided in the area of the longitudinal sides which are mounted to the rear wall, on the one hand, and on the front plate, on the other hand.

Drawers of the aforementioned type are known.

In the hitherto known drawers of the foregoing type the front plate is always made from one piece.

This means that the front plate must be cut at its upper edge area if it consists of wood, and if it consists of plastic it must be molded in a corresponding mold or must also be cut at the upper edge area.

SUMMARY OF THE INVENTION

It is an object of the invention to construct a drawer of this type in such a manner that the front plate can be made simply and cost effective.

This object is solved in accordance with the invention in that the front plate consists of a rectangular plate, made of wood or plastic and two shaped parts which are mounted in the upper edge area of the plate and which are provided with one shank extending over the given corner and another upright protruding shank, whereby the upper struts are secured on the upwardly protruding shanks of the shaped parts.

By the shaped parts which are mounted on the plate a front plate is formed which again is provided with a recess in its edge area. The required individual parts consists of the rectangular plate and mentioned shaped parts. The shaped parts can be made comparably inexpensive in corresponding quantities. The same holds true for a simple, rectangular plate, on which no further processing have to be performed. Therefore, the total costs for such a front plate are finally considerably less expensive than with a unitary front plate.

A further advantage of the invention resides in the fact that the making of differently sized front plates does not present any difficulties, since the shaped parts can always be used independently from the dimensions of the front plate.

DETAILED DESCRIPTION OF THE PREFERRED EMBODIMENT

Figure 1:
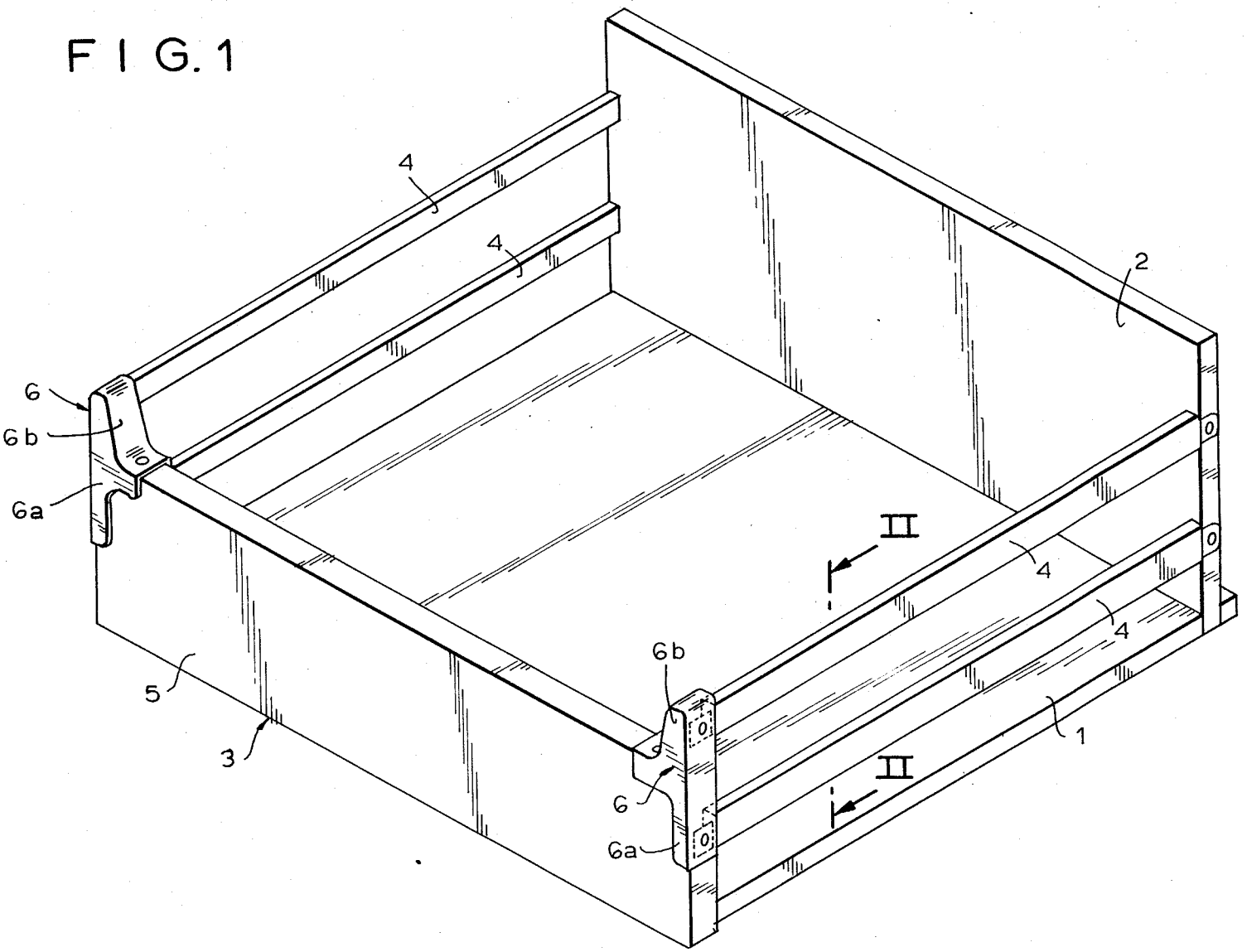
FIG. 1 is a perspective illustration of a drawer in accordance with the invention.

The drawer illustrated in FIG. 1 essentially consists of a bottom 1, a rear wall 2, a front plate 3 struts 4 which are mounted along the longitudinal side and are mounted on the rear wall 2, on the one hand, and on the other hand, on the front plate.

The drawing is constructed in form of an english train, that means the front plate 3 is provided with a recess at its upper edge area.

Figure 2:
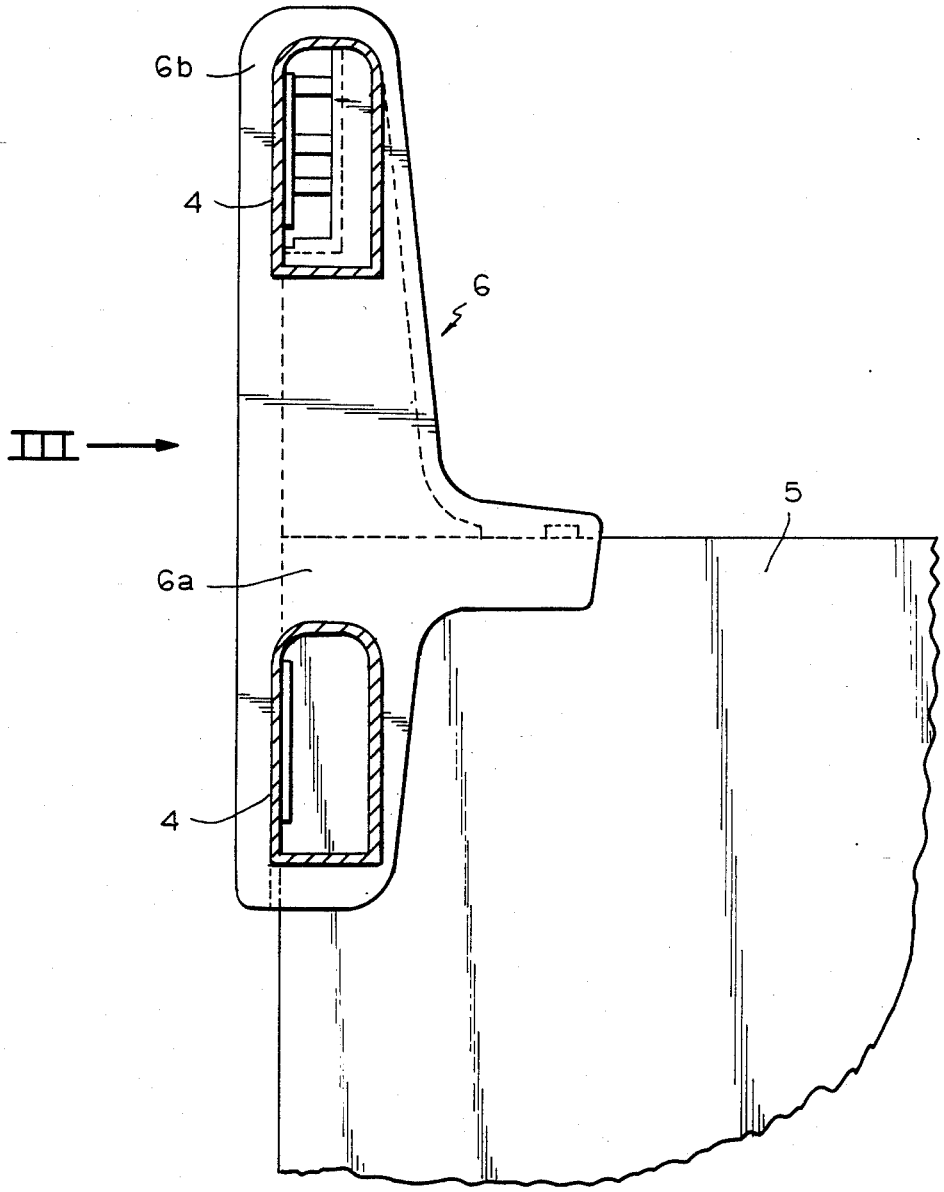
FIG. 2 is a partial section in accordance with line II—II of FIG. 1.
Figure 4:
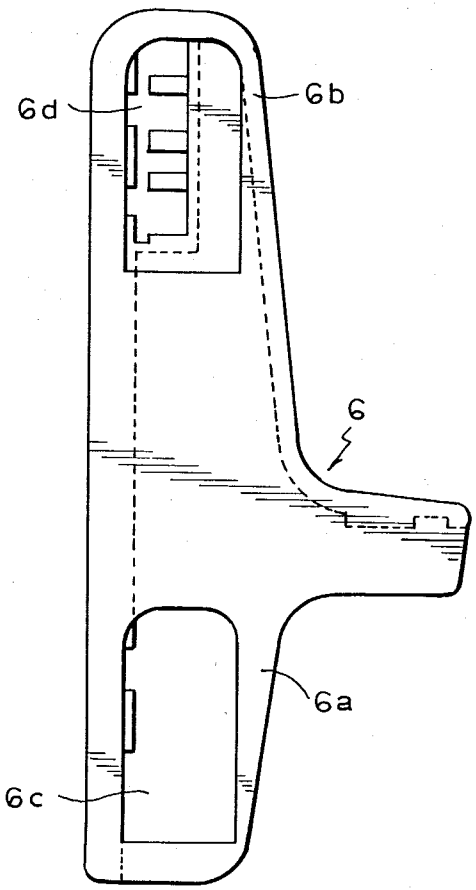
FIG. 4 is a view in direction of the arrow IV in FIG. 3.
Figure 3:
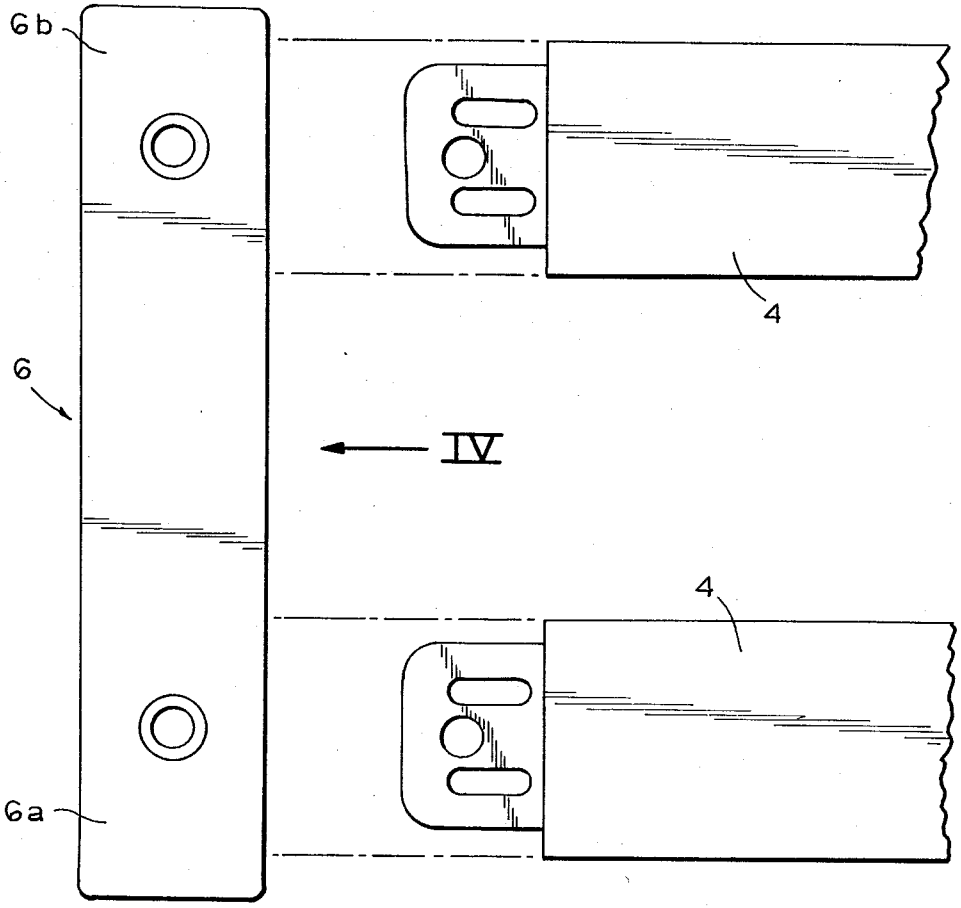
FIG. 3 is a partial view in direction of the arrow III in FIG. 2.

As FIGS. 1 and 2 clearly illustrate, the front plate 1 consists of a rectangular plate 5 made from wood or plastic, as well as two shaped parts 6. These shaped parts 6 are mounted on the given upper corner area of the plate and extend over the given corner. The shaped parts 6 are provided each with one shank 6*a* which extends over the corresponding corner of the plate 5. Moreover, the shaped parts 6 are provided each with an upright directed shank 6*b*, so that the structure of the shaped parts 6 is T-shaped.

The upper struts 4 are mounted on the upright extending shanks 6*b* of shaped parts 6.

The lower struts 4 are mounted in the area of the front plate 3 together with the shaped parts 6 on plate 5, which is particularly illustrated in FIG. 1.

The shaped parts 6 are made from unitary pieces and and are plastic and are open at the segments which extend over the given corner of plate 5. Otherwise, the shaped parts 6 are closed with the exception of assembly openings 6*c* and 6*d* through which the struts 4 are fed. This means that after the mounting of the shaped parts 6 on plate 5 and after mounting the struts 4 the front plate 3 is completely closed.

The insertion of the shaped parts 6 is independent from the size of plate 5, so that any given size drawers can be equipped with a front plate 3 in a simple manner by means of the aforementioned mode and which are provided with a recess in their upper edge area.

We claim:

1. A drawer, comprising a front plate; a rear wall; and two pairs of parallel longitudinal struts extending at two opposing longitudinal sides of the drawer and secured to said rear wall, said front plate including a substantially rectangular plate made of wood or plastic and having a recess in an upper edge area thereof and two T-shaped connecting parts mounted at two opposing edges of said rectangular plate, each of said pairs including an upper strut and a lower strut, said plate having an upper surface, said T-shaped connecting parts each including a lower shank extending downwardly from said upper surface and receiving said lower strut of a respective pair of said longitudinal struts, an upper shank extending upwardly from said upper surface and receiving said upper shank of the respective pair, and an intermediate portion engaging said upper surface, whereby each strut is mounted to said front plate.

2. The drawer as defined in claim 1, wherein each connecting part is made of a unitary plastic piece.

3. The drawer as defined in claim 1, wherein said rectangular plate has two end faces, said lower shank of each connecting part partially engaging a respective end face of said rectangular plate.

4. The drawer as defined in claim 3, wherein each connecting part has openings for receiving said pair of parallel struts and is a piece substantially closed at three sides thereof.

* * * * *